US011497287B2

(12) United States Patent
Quesnel

(10) Patent No.: US 11,497,287 B2
(45) Date of Patent: Nov. 15, 2022

(54) PURSE WITH CONNECTOR AND NESTING PURSE

(71) Applicant: Etoile Holdings, Ltd., Southlake, TX (US)

(72) Inventor: Annye Quesnel, Southlake, TX (US)

(73) Assignee: Etoile Holdings, Ltd., Southlake, TX (US)

( * ) Notice: Subject to any disclaimer, the term of this patent is extended or adjusted under 35 U.S.C. 154(b) by 338 days.

(21) Appl. No.: 16/577,898

(22) Filed: Sep. 20, 2019

(65) Prior Publication Data

US 2020/0093235 A1 Mar. 26, 2020

Related U.S. Application Data

(60) Provisional application No. 62/734,119, filed on Sep. 20, 2018.

(51) Int. Cl.
*A45C 7/00* (2006.01)
*A45C 1/02* (2006.01)
*A45C 13/10* (2006.01)

(52) U.S. Cl.
CPC ..... *A45C 7/009* (2013.01); *A45C 1/02* (2013.01); *A45C 13/1069* (2013.01); *A45C 13/103* (2013.01)

(58) Field of Classification Search
CPC ..... A45C 7/009; A45C 1/02; A45C 13/1069; A45C 13/103
See application file for complete search history.

(56) References Cited

U.S. PATENT DOCUMENTS

| | | | | |
|---|---|---|---|---|
| 1,962,594 | A * | 6/1934 | Herrmann | A45C 13/103 190/114 |
| 2,665,728 | A * | 1/1954 | Hyman | A45C 3/06 150/110 |
| 2,923,338 | A * | 2/1960 | Stember | A45C 1/02 150/120 |
| 2,925,841 | A * | 2/1960 | Brunner | A45C 3/02 190/115 |
| 3,963,102 | A * | 6/1976 | Carp | A45C 3/00 190/108 |
| 6,070,628 | A | 6/2000 | Nastasi | |
| 7,527,430 | B2 * | 5/2009 | Suskind | B65D 33/06 190/103 |
| 9,078,503 | B1 * | 7/2015 | Gilman | A45C 13/20 |
| 9,254,024 | B2 * | 2/2016 | DeWitt | A45C 13/30 |

(Continued)

OTHER PUBLICATIONS

PCT International Application No. PCT/US2019/052252, International Search Report and Written Opinion dated Nov. 25, 2019, 16 pgs.

*Primary Examiner* — Tri M Mai
(74) *Attorney, Agent, or Firm* — Foley & Lardner LLP

(57) ABSTRACT

A main purse with connector and nesting purse, as well as related systems and methods is provided. The nesting purse is smaller than the main purse and is nestable therein. The nesting purse may be fixed inside the main purse by nesting purse attachments, such as to prevent separation of the primary purse and the nesting purse. The main purse may be selectably enlarged by the flipping up of a top portion. An overlay closure flap may have multiple magnetic closures so that the overlay closure flap can close over the top portion in both flipped up and flipped down configurations.

11 Claims, 18 Drawing Sheets

(56) References Cited

U.S. PATENT DOCUMENTS

| | | | | |
|---|---|---|---|---|
| 2006/0090976 | A1 | 5/2006 | Repke et al. | |
| 2012/0111930 | A1* | 5/2012 | Maistrellis | B42F 7/04 229/67.3 |
| 2016/0183649 | A1* | 6/2016 | Gamble | A45C 7/0086 150/107 |
| 2017/0020252 | A1 | 1/2017 | Chin | |

* cited by examiner

PURSE WITH CONNECTOR AND NESTING PURSE

CROSS-REFERENCE TO RELATED APPLICATIONS

This application claims priority to, and the benefit of, U.S. Provisional Patent Application Ser. No. 62/734,119 entitled "PURSE WITH CONNECTOR AND NESTING PURSE" filed on Sep. 20, 2018, the contents of which are hereby incorporated herein by reference in their entirety for any purpose.

FIELD

The present disclosure relates generally to a purse, and more specifically to a purse with a nesting purse nestable therein, and related systems and methods.

BACKGROUND

Frequently individuals carry different purses of different sizes. For example, a person needing supplies for a full day away from home may carry a large purse. However, a person running a brief errand may only carry a small purse, as fewer supplies may need to be carried. A person traveling a fitness center may carry a large purse with many items and/or a change of clothing, while a person traveling from a fitness center locker room to a fitness class may carry a small purse with few items, such as a phone and/or personal care products. Challenges arise when circumstances suggest a change from a large purse to a small purse, or from a small purse to a large purse.

SUMMARY

The forgoing features and elements may be combined in various combinations without exclusivity, unless expressly indicated herein otherwise. These features and elements as well as the operation of the disclosed embodiments will become more apparent in light of the following description and accompanying drawings.

A reconfigurable purse assembly is provided. The assembly may include a main bag including a top portion that has a first flap and a second flap that are selectably extendable. The assembly may include an overlay closure flap having a main flap body attached to a first side of the main bag by a closure flap attachment mechanism and selectably magnetically attachable to a second side of the main bag at at least one of a plurality of magnetic closures. In various embodiments, a first magnetic closure of the plurality of magnetic closures accommodates the overlay closure flap crossing over the top portion in a selectably retracted configuration, and a second magnetic closure accommodates the overlay closure flap crossing over the top portion in the selectably extended configuration. The main bag may further include a nesting bag retention system configured to selectably connect to a nesting bag disposed in an opening of the main bag.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

Figure 1A:
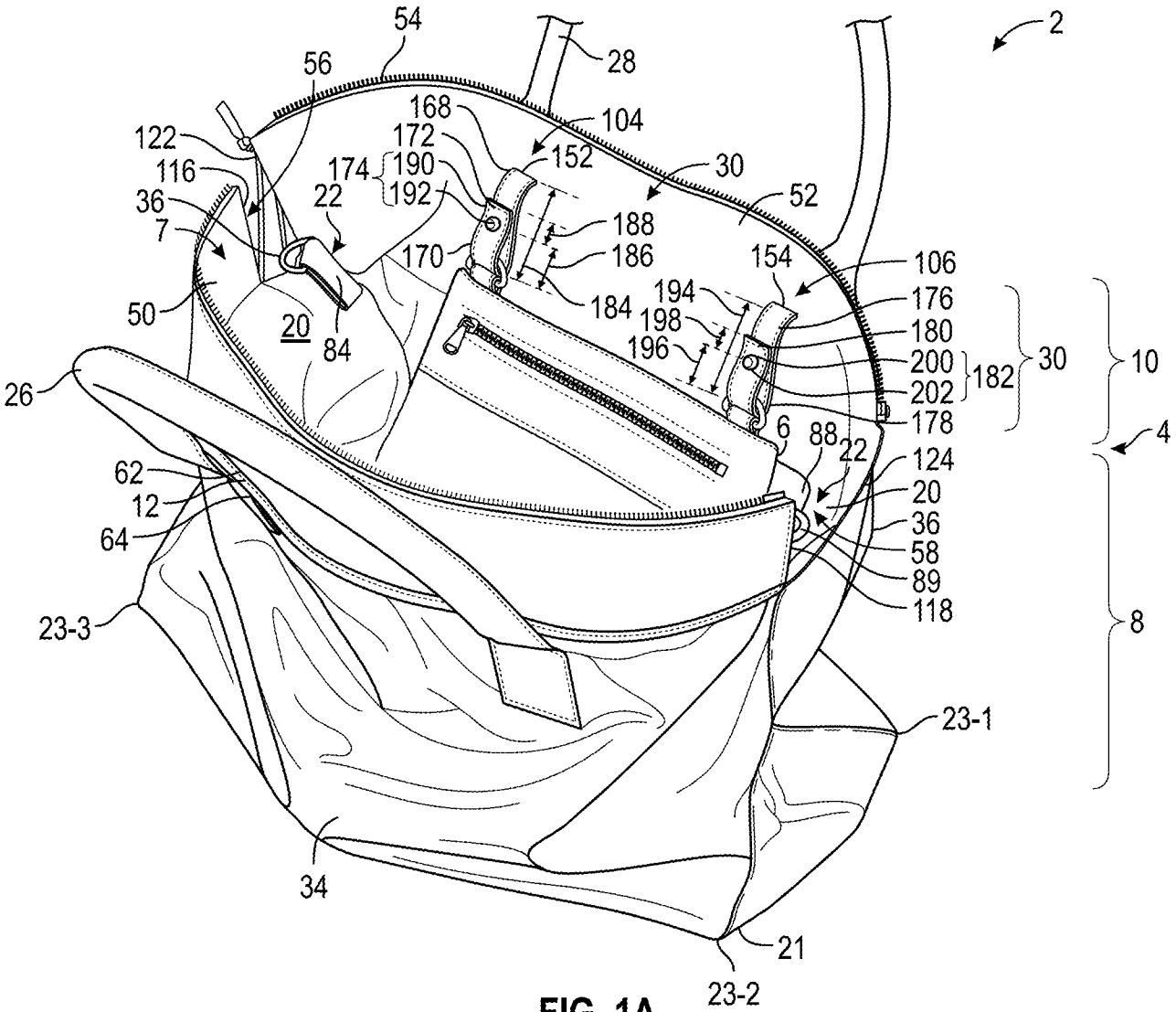
FIGS. 1A-C illustrate aspects of a reconfigurable purse assembly, in accordance with various embodiments.

The detailed description of exemplary embodiments herein makes reference to the accompanying drawings, which show exemplary embodiments by way of illustration. While these exemplary embodiments are described in sufficient detail to enable those skilled in the art to practice embodiments of the disclosure, it should be understood that other embodiments may be realized and that logical changes and adaptations in design and construction may be made in accordance with this invention and the teachings herein. Thus, the detailed description herein is presented for purposes of illustration only and not limitation. The scope of the disclosure is defined by the appended claims. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Furthermore, any reference to singular includes plural embodiments, and any reference to more than one component or step may include a singular embodiment or step. Surface shading lines may be used throughout the figures to denote different parts but not necessarily to denote the same or different materials.

In various example embodiments, a primary purse with a connector and a nesting purse is provided. The nesting purse is smaller than the primary purse and is nestable therein. The nesting purse may be fixed inside the primary purse by nesting purse attachments, such as to prevent separation of the primary purse and the nesting purse. A cross-body strap of the primary purse is detachable from the primary purse and is attachable to the nesting purse attachments of the nesting purse. Thus, the nesting purse may be disconnected from inside the primary purse at the nesting purse attachments, and the cross-body strap of the primary purse may be detached from the primary purse and attached to the nesting purse attachments of the nesting purse, facilitating separate carrying of the nesting purse.

Directing specific attention now to FIG. 1, an example reconfigurable purse assembly 2 is depicted. An example reconfigurable purse assembly 2 may include a main bag 4 with a connector (nesting bag retention system 30) and a nesting bag 6 as discussed above. Notably however, while the word "purse" or "bag" is used herein throughout, one may appreciate that totes, satchels, briefcases, bags, purses, and other carrying articles are contemplated. For instance, while reference is made to a "purse" with respect to the specific embodiments depicted in the figures, one may appreciate that the main purse, as depicted, further comprises a tote bag and the nesting purse, as depicted, further comprises a handbag, yet with a cross-body strap. Thus, conventional boundaries, both of terminology, and of fashion are advanced and challenged by various embodiments of systems, methods, and apparatuses disclosed herein.

The reconfigurable purse assembly 2 may include a main bag 4. As used herein, a main bag 4 comprises a tote bag, thought other bag or purse types or configurations are contemplated. The main bag 4 may be provided in a variety of styles, shapes, and colors, and may be configured for shoulder carrying, cross body carrying, carrying with a handle, carrying with a strap, and/or any configuration as desired.

The reconfigurable purse assembly 2 may include a nesting bag 6. A nesting bag 6 also may comprise a tote bag, thought as shown herein; the nesting bag 6 comprises a cross-body purse. The nesting bag 6 is selectably connectable to the main bag 4 by a nesting bag retention system 30 configured to retain the nesting bag 6 inside a cavity defined inside the main bag 4. In various instances, the nesting bag 6 is retained inside a cavity of the primary bag not externally visible (e.g., to an observer not carrying the bag and standing apart at least 3 feet therefrom). In various instances, the nesting bag 6 and the nesting bag retention system 30 are disposed entirely within a cavity of the main bag 4.

The nesting bag 6 will be discussed in detail later herein, however, attention now is directed to the main bag 4, and specifically, FIG. 1A. In various instances, the main bag 4 comprises a main body 8 and a top portion 10. A main body 8 may comprise an open-ended vessel configured to receive and retain personal items, etc. For example, a main body 8 may comprise a nylon bag having an opening for the insertion of personal items. The main body 8 may be attached to a top portion 10. The top portion 10 may comprise a different material than the main body 8, or may comprise a same material, or may comprise a combination of materials. In various embodiments, the top portion 10 comprises leather.

Figure 3:
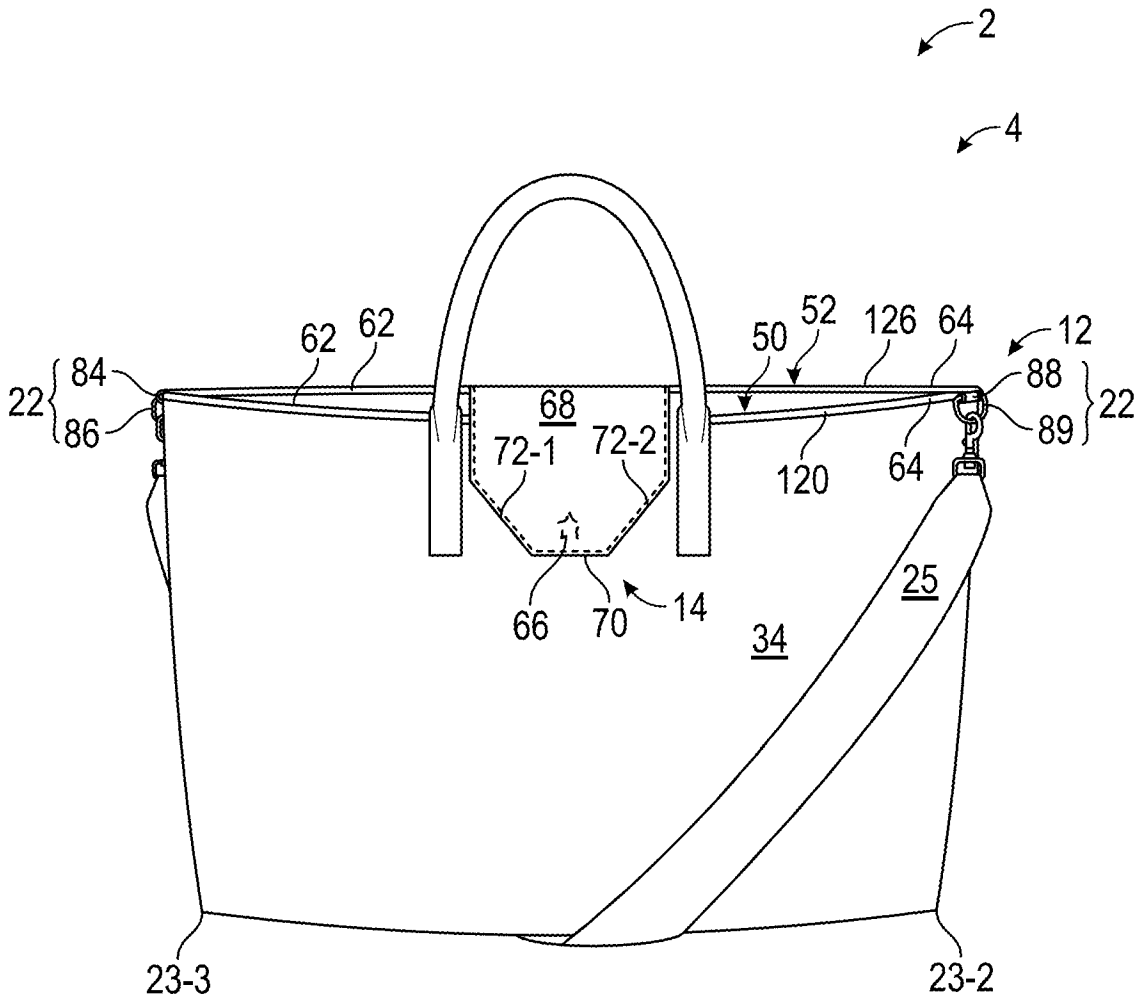
FIG. 3 provides a front view of an example main bag of a reconfigurable purse assembly, in accordance with various embodiments.

A top portion 10 may comprise a portion of the main bag 4 proximate to an opening 7 of the main body 8. The top portion 10 may be selectably extendable and selectably retractable. This means, for example, that the top portion 10 may be "flipped up" so that it extends approximately parallel to the surface of the main body 8 (e.g., upwardly when the opening of the main body 8 is upward facing as shown in FIG. 1A). The top portion 10 may be "flipped down" so that it is retracted into the cavity and at least partially within the profile of the main bag 4, as shown in FIG. 3. In this manner, the main bag 4 may be changed between a larger (FIG. 1A) and a smaller configuration (FIG. 3), the larger configuration being with the top portion 10 flipped up and extending, and the smaller configuration being with the top portion 10 flipped down and received into the cavity.

The union of the main body 8 to the top portion 10 may be a main-body-to-top-portion juncture (MBTP juncture 12). A MBTP juncture 12 may comprise a seam joining the main body 8 and the top portion 10. The MBTP juncture 12 further provides a hinge for the top portion 10 so that the top portion 10 may transition between flipped up and flipped down configurations. With reference to FIGS. 1A and 3, the MBTP juncture 12 may comprise an outer seam 62 and inward piping 64. Stitching and/or gluing may join a top portion 10 to an outer face of the main body 8. For instance, the top portion 10 may overlap the main body 8 when viewed from the outside. In this manner, the top portion 10 may provide protection to the edge of the main body 8. For instance, the top portion 10 may be leather and the main body 8 may be nylon. The leather may overlay the edge of the nylon, to facilitate improved durability. Moreover, the inward piping 64 may be disposed within or adjacent to the seam, reinforcing the portion of the leather that overlays the edge of the nylon, further facilitating durability and providing even bend lines when the top portion hingeably transitions between flipped up and flipped down configurations.

Turning attention to FIGS. 1B, 3, 4, and 10, a main bag 4 may include an overlay closure flap 14. An overlay closure flap 14 may comprise a member extending across an opening of the main bag 4, from one side of the main bag 4 to an opposite side of the main bag 4. The overlay closure flap 14 may overlay an opening that is defined between the one side and opposite side mentioned above. The overlay closure flap 14 may limit unwanted gaping of the opening defined between the two sides, so that articles retained in the bag do not unwantedly fall out of the bag. In various instances, the overlay closure flap 14 is selectably closable, for instance, being affixed to one side of the bag and connectable/disconnectable to the other side of the bag. For example, a magnetic closure may be implemented. While a leather strap and magnet are featured herein, one may appreciate that an overlay closure flap 14 may comprise any mechanism configured to selectably close the main bag 4 may be implemented. The overlay closure flap 14 may include multiple magnets and/or ferromagnetic material that interoperate with a magnet or ferromagnetic material disposed in the top portion. Multiple magnets may facilitate the closure of the overlay closure flap 14 regardless of whether the top portion 10 is in the flipped up or flipped down configuration. The overlay closure flap 14 may include a single magnet and/or ferromagnetic material and a plurality of magnets or ferromagnetic material may be disposed in the top portion.

Figure 6:
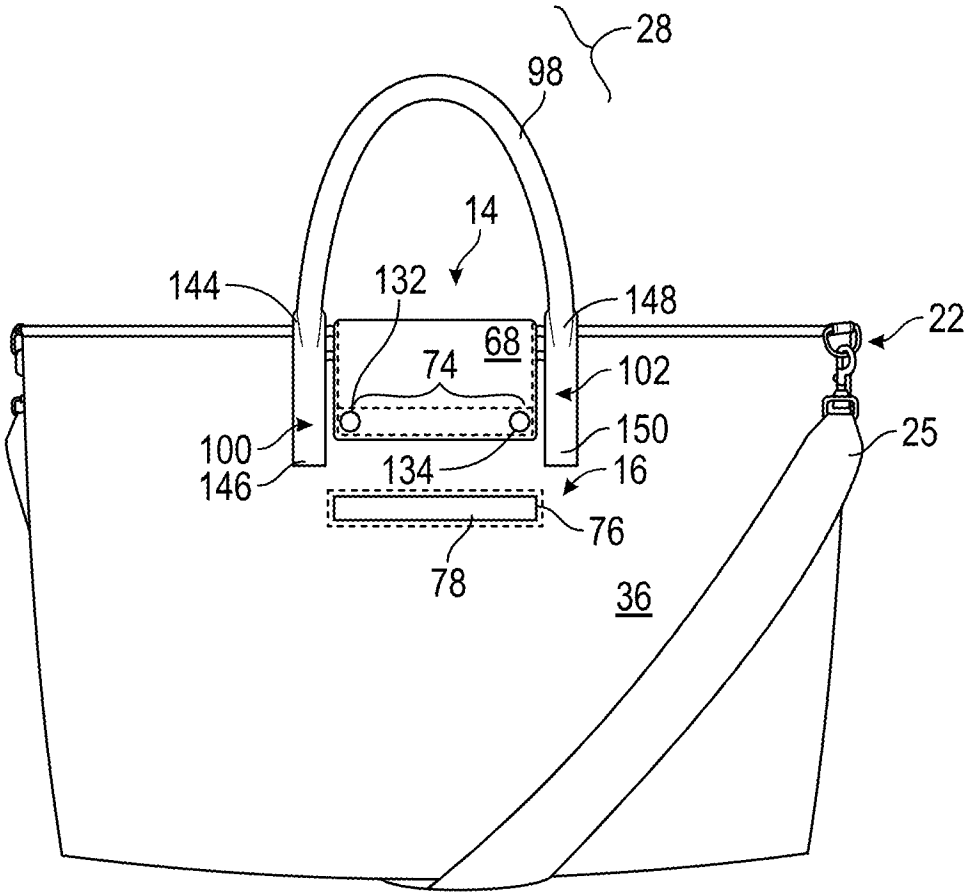
FIG. 6 provides a rear view of an example main bag of a reconfigurable purse assembly, in accordance with various embodiments.
Figure 7:
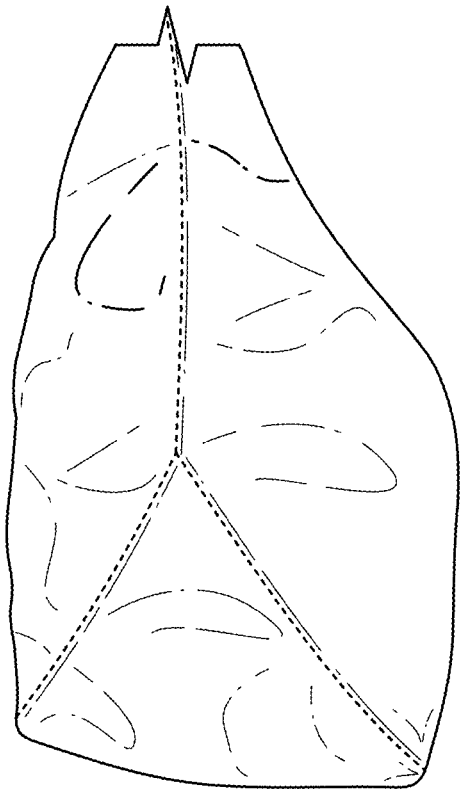
FIGS. 7-8 provide side views of an example main bag of a reconfigurable purse assembly, in accordance with various embodiments.
Figure 8:
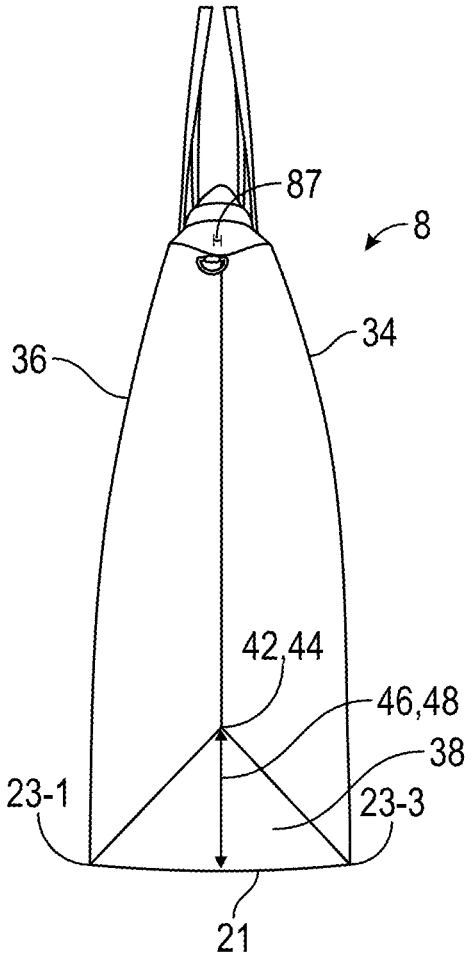

Briefly referencing FIG. 6 in addition to FIG. 1A, the main bag 4 may also include an exterior pocket 16. An exterior pocket 16 may comprise an aperture disposed in a side of the main body 8, for instance a first larger panel 34 or a second larger panel 36. The exterior pocket 16 may be configured to receive a cellular telephone, wallet, and or other personal item for ready access without requiring opening of the main bag 4. The exterior pocket 16 may comprise a main body larger panel aperture 76. A main body larger panel aperture 76 comprises an aperture defined through one of the first larger panel 34 or second larger panel 36. The aperture may open into a retention sleeve 78. A retention sleeve 78 may comprise a closed sock disposed interstitially between the relevant of the first larger panel 34 or second larger panel 36 and the liner 20 (FIG. 1A) of the main bag 4. Thus, the exterior pocket 16 may be separate from the main cavity of the main bag 4.

Figure 10:
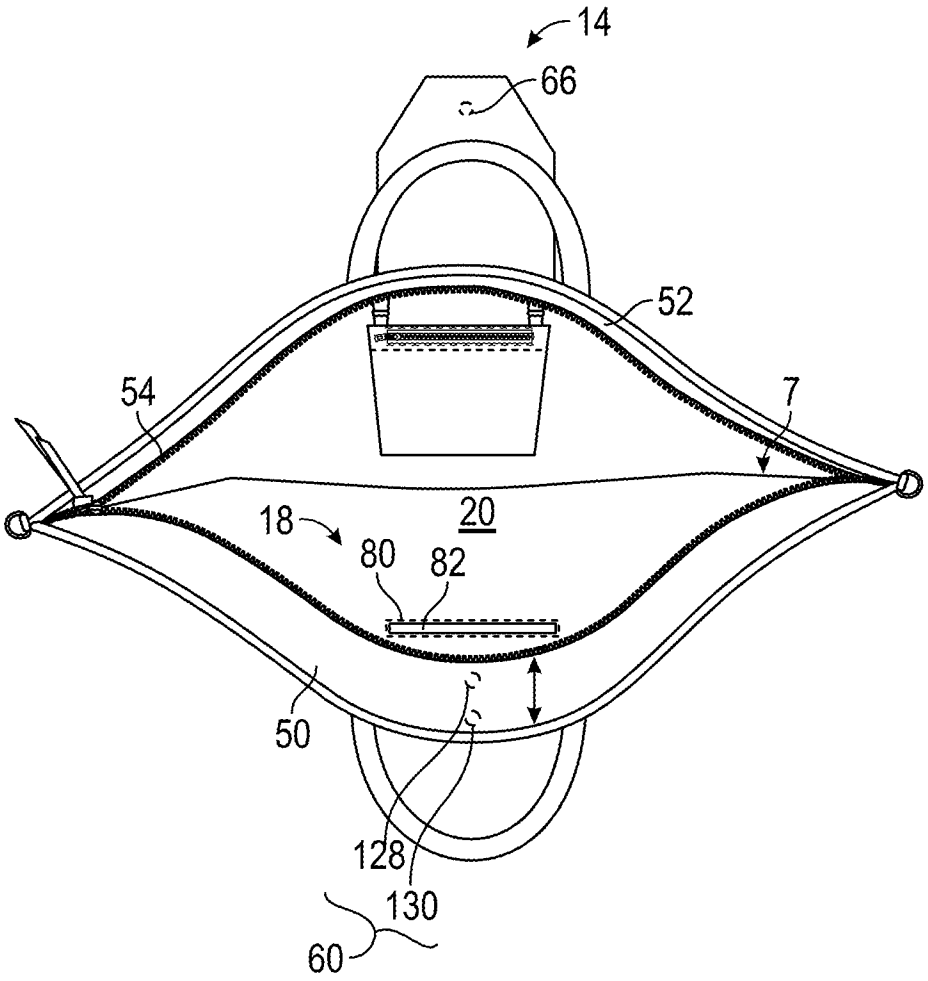
FIG. 10 provides an inward top-down view of an example main bag of a reconfigurable purse assembly and depicting specific features of the overlay closure flap and the selectably extendable and selectably retractable top portion of the main bag, in accordance with various embodiments.
Figure 11:
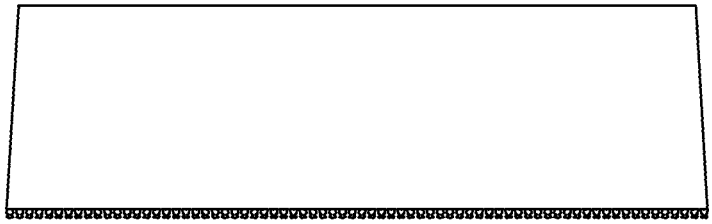
FIG. 11 provides a view of aspects of a first flap and/or second flap of a top portion of a main bag, in accordance with various embodiments.
Figure 12:
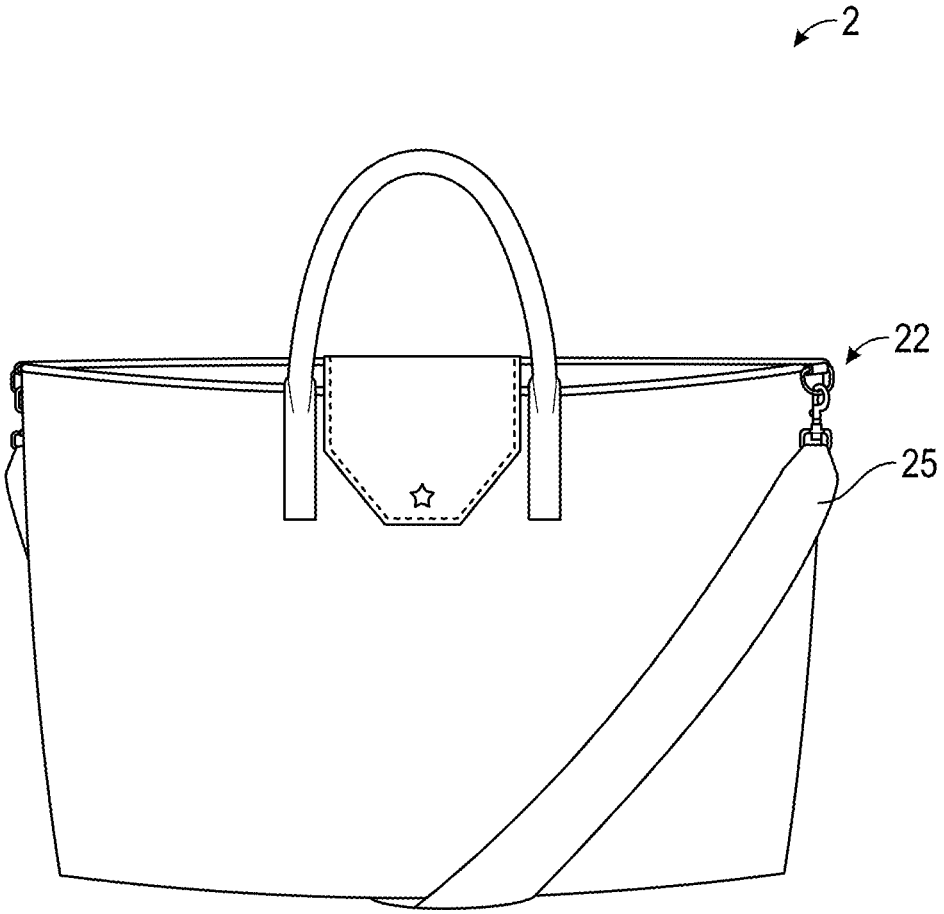
FIG. 12 provides a view of an example main bag of a reconfigurable purse assembly in connection with a cross body strap, in accordance with various embodiments.
Figure 13:
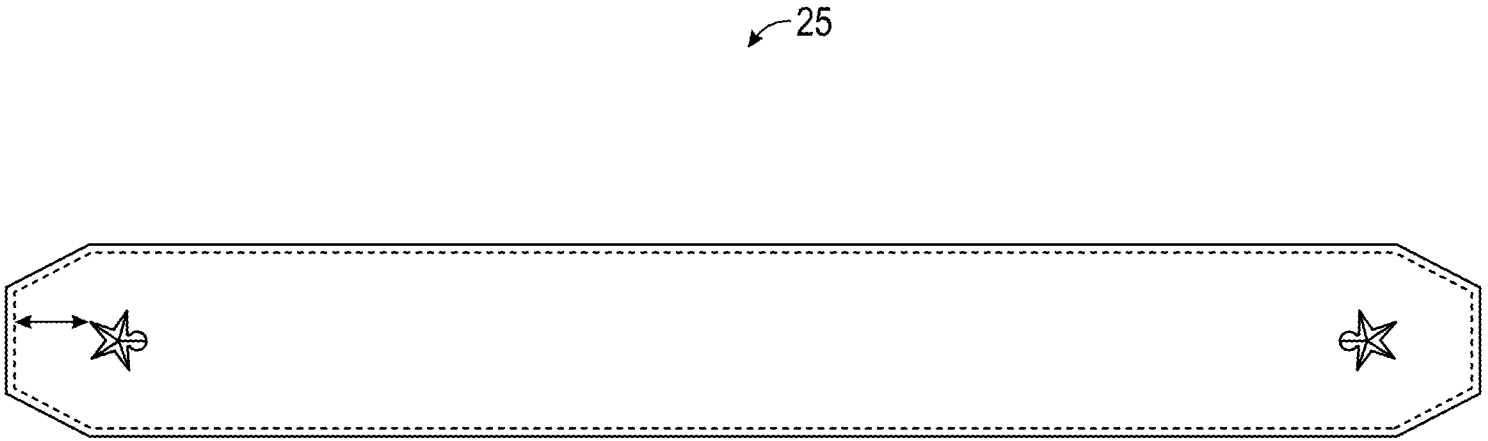
FIGS. 13-16 depict aspects of an example cross body strap of a reconfigurable purse assembly, in accordance with various embodiments.
Figure 16:
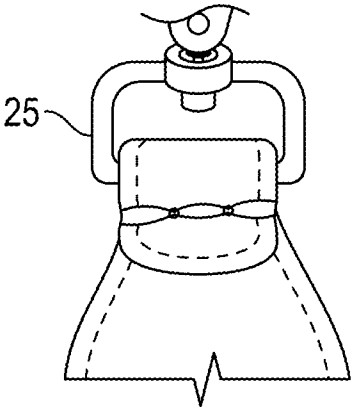
Figure 15:
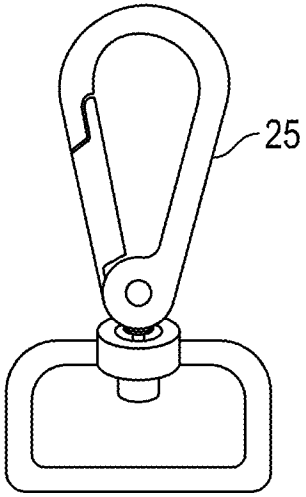
Figure 14:
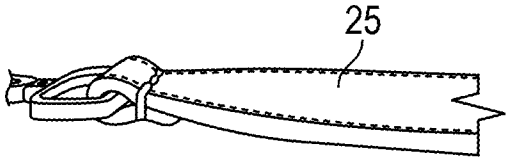

Similarly, and with reference to FIG. 10, the main bag 4 may include an interior pocket 18. An interior pocket 18 may comprise an aperture disposed in a liner 20 of the main body 8 (FIG. 1A). The interior pocket 18 may be configured to receive a cellular telephone, wallet, and or other personal item. The interior pocket 18 may comprise a liner aperture 80 and a retention sleeve 82. A liner aperture 80 may comprise an aperture defined through the liner 20. The liner aperture 80 may open into a retention sleeve 82. A retention sleeve 82 may comprise a pocket and/or sock-like vessel disposed interstitially between the liner 20 and one of the relevant of the first larger panel 34 or second larger panel 36 (FIG. 1A) of the main bag 4.

With continuing reference to FIG. 10, the main bag 4 may include a liner 20. A liner 20 may comprise an inner surface of the main bag 4 defining the cavity of the bag. Although the bag may be made of a main body 8 and a top portion 10, in various embodiments, a liner 20 is shared by both the main body 8 and the top portion 10 and lines an inner surface of the main bag 4 provided by both the main body 8 aspect and the top portion 10 aspect. The liner 20 may be suede. The liner 20 may be any material as desired. The liner 20 may be affixed to the main body 8 and/or top portion 10 by at least one of stitching, gluing, and/or the like.

With returned focus to FIG. 1A, the main bag 4 may have a strap fixation system 22. A strap fixation system 22 may join a cross-body strap 25 (FIG. 1B, 2, 3, 12, 13-16) or other carrying strap to the main bag 4. The strap fixation system 22 may comprise one or more metal ring, fabric or leather loop, chain, rope, strap, and/or other aspect as required. Specific features of one example strap fixation system 22 will be detailed more specifically herein below.

The main bag 4 may have handles. The handles may be configured to permit carrying of the main bag 4 such as via a hand or a shoulder of a user. The handles may comprise a first side handle 26 and a second side handle 28. A first side handle 26 may be attached to the main bag 4 on a side of the main bag 4 that is opposite a side to which the second side handle 28 is similarly attached. For example, a first side handle 26 may be attached to a first larger panel 34 of a main body 8 and a second side handle 28 may be attached to a second larger panel 36 of a main body 8. The first side handle 26 and/or second side handle 28 may be leather, cloth, or any material as desired.

The main bag 4 may have a nesting bag retention system 30. A nesting bag retention system 30 comprises one or more connection between the main bag 4 and a nesting bag 6 retainable inside the main bag 4. The nesting bag retention system 30 is operable to connect and also to disconnect the main bag 4 and the nesting bag 6.

The general aspects of the main bag 4 have now been introduced. Following below is a discussion of the specific aspects of each feature that has been introduced above. For instance, with renewed attention to the main body 8 of the main bag 4, focus is directed back to FIGS. 1A, as well as 1B-12, for an elaboration of additional features. For example, a main body 8 may include a first larger panel 34 and a second larger panel 36. The first larger panel 34 comprises a larger side of the main body 8. Similarly, the second larger panel 36 comprises a larger side of the main body 8 opposite to the first larger panel. The first larger panel 34 and the second larger panel 36 may be a same size, or may be different sizes. The first larger panel 34 and the second larger panel 36 are sewn together at corresponding edges along at least a portion of the length of the relevant edges. For example, a first larger panel 34 and a second larger panel 36 are sewn together from the MBTP juncture 12 downwardly along the main body 8.

The main body 8 may also include a first side insert 38. A first side insert 38 may comprise a triangular panel. For instance, the first larger panel 34 and the second larger panel 36 may be sewn together from the MBTP juncture 12 downwardly along the main body 8 to a vertex of the first side insert 38, the vertex comprising a first seam intersection point 42. The first larger panel 34 may be sewn to one side of the first side insert 38 extending from the vertex comprising the first seam intersection point 42. The second larger panel 36 may be sewn to another side of the first side insert 38 extending from the vertex comprising the first seam intersection point 42. The first side insert 38 may facilitate a widening of the main body 8 at distances farther away from the MBTP juncture 12. In various embodiments, the first seam intersection point 42 is spaced a first side insert seam offset distance 46 from the floor of the main body 8. In various instances, the first side insert seam offset distance 46 is less than one half the height of the main body 8.

The main body 8 may also include a second side insert 40. A second side insert 40 may comprise a triangular panel. For instance, the first larger panel 34 and the second larger panel 36 may be sewn together from the MBTP juncture 12 downwardly along the main body 8 to a vertex of the second side insert 40, the vertex comprising a second seam intersection point 44. The first larger panel 34 may be sewn to one side of the second side insert 40 extending from the vertex comprising the second seam intersection point 44. The second larger panel 36 may be sewn to another side of the second side insert 40 extending from the vertex comprising the second seam intersection point 44. The second side insert 40 may facilitate a widening of the main body 8 at distances farther away from the MBTP juncture 12. In various embodiments, the second seam intersection point 44 is spaced a second side insert seam offset distance 48 from the floor of the main body 8. In various instances, the second side insert seam offset distance 48 is less than one half the height of the main body 8.

The second side insert 40 and the first side insert 38 maybe disposed on opposite sides of the main body 8. Thus the first larger panel 34, the first side insert 38, the second larger panel 36, and the second side insert 40 may be joined edge to edge to form the main body 8. Moreover, the first side insert 38 and the second side insert 40 may comprise triangular end portions of a same piece of material with an interstitial rectangular portion therebetween. Thus, one may appreciate that since the first side insert 38 and second side insert 40 form portions of sides of the main body 8, the interstitial rectangular portion extending between the first side insert 38 and the second side insert 40 may form a floor 21 of the main body 8. Thus, the union of the floor 21, first side insert 38 and second side insert 40, which may be of a same piece of material, to the first larger panel 34 and the second larger panel 36, may form a cavity with an opening proximate to the top portion 10 and configured to receive articles for carrying. The floor 21, first side insert 38, and second side insert 40, which may be one piece of material, may be joined to the first larger panel 34 and the second larger panel 36 by stitching. In various embodiments, with specific momentary focus on FIGS. 1A, 1B, 1C, 3, and 8, the corners 23-1, 23-2, 23-3, 23-4 of the floor 21 of the main body 8 are tucked inward, so that each corner 23-1, 23-2, 23-3, 23-4 comprises a local concave dimple of the main body 8. In this manner, wear of the corners may be ameliorated as compared to traditional constructions which have pointed corners that tend to wear and/or fray.

Figure 9:
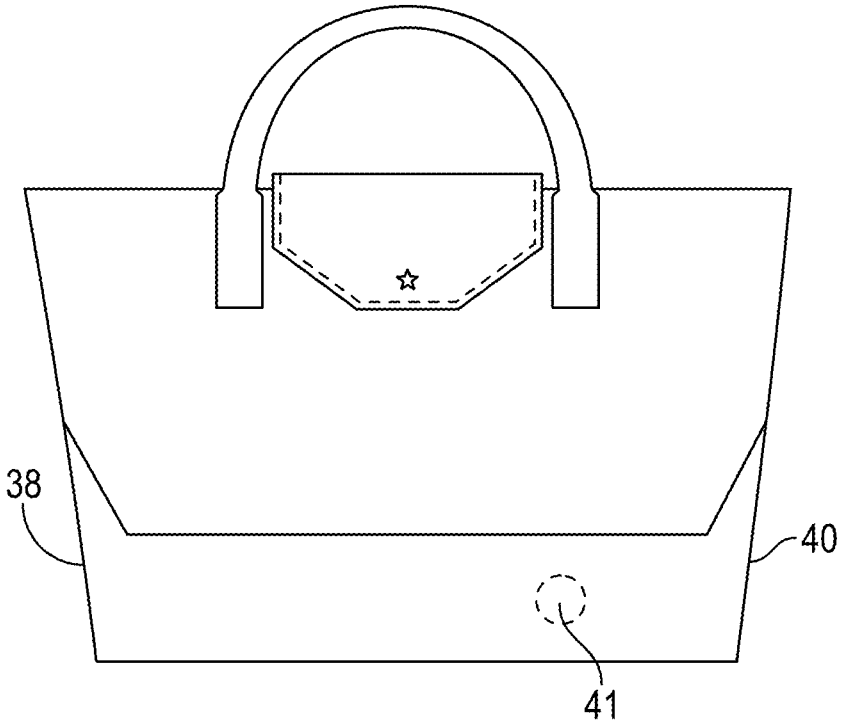
FIG. 9 provides a front view of internal aspects of an example main bag of a reconfigurable purse assembly, in accordance with various embodiments.

The main body 8 may also include insert filler 41 (FIG. 9). The insert filler 41 may comprise a layer of material installed inwardly of the first side insert 38 and the second side insert 40 within the inside of the cavity of the main body 8 but between the main body 8 and the liner 20 (FIG. 1A) so as to be hidden within the construction of the main body 8. The insert filler 41 may provide thickening and/or reinforcement and/or rigidity to the main body 8. For instance, the insert filler 41 may reinforce a lower half of the main body 8, facilitating the maintenance by the main body 8 of its shape.

The discussion of specific aspects of the main body 8 is complete. Attention is now directed to FIG. 1A, 10 and to the top portion 10 for a discussion of specific aspects of the top portion 10. In various instances, the top portion 10 may comprise a first flap 50 and a second flap 52. In various instances, the first flap 50 extends along at least a portion of an edge of the first larger panel 34 of the main body 8. Similarly, in various instances the second flap 52 extends along at least a portion of an edge of the second larger panel 36 of the main body 8. The first flap 50 comprises a rectangular shape, though any other shape as desired, may be chosen. Similarly, the second flap 52 comprises a rectangular shape, though any other shape as desired may be chosen.

In various embodiments, the first flap 50 extends along a portion of an edge of the main bag. The first flap 50 may extend along a portion of an edge of the first larger panel 34 of the main body 8. In various instances, the first flap extends along a portion of an edge of the first larger panel 34 of the main body 8, but not the entire edge. The mentioned edge may be a top edge, meaning the edge farthest from the floor 21 of the main body 8. In various embodiments, the second flap 52 may extend along a portion of an edge of the main bag. The second flap 52 may extend along a portion of an edge of the second larger panel 36 of the main body 8. In various instances, the second flap 52 extends along a portion of an edge of the second larger panel 36 of the main body 8, but not the entire edge. The mentioned edge may be a top edge, meaning the edge farthest from the floor 21 of the main body 8.

Thus, since one or more of the first flap 50 and second flap 52 extend along less than an entire length of their respective edge of their respective first larger panel 34 and second larger panel 36, one may appreciate that a gap may be defined by the first flap 50 and the second flap 52. In various embodiments, a first edge 116 of a first flap 50 faces towards a first edge 122 of a second flap 52, and similarly, a second edge 118 of the first flap 50 faces toward a second edge 118 of the second flap 52. In various embodiments a gap is defined between the first edge 116 of the first flap 50 and the first edge 122 of the second flap 52. This gap comprises the first strap passage aperture 56 configured to facilitate a cross-body strap 25 passing between the first flap 50 and second flap 52. In various embodiments a gap is defined between the second edge 118 of the first flap 50 and the second edge 124 of the second flap 52. This gap comprises a second strap passage aperture 58 also configured to facilitate a cross-body strap 25 passing between the first flap 50 and the second flap 52. A cross-body strap 25 can pass through the first strap passage aperture and also through the second strap passage aperture and connect to the main body inside the cavity of the bag, so that the bag can readily be carried with the first closure mechanism 54 (FIG. 1A) both closed, and opened.

The top portion 10 may also have a first closure mechanism 54. For example, the first flap 50 and the second flap 52 may be connectable together to close the cavity of the main body 8. In this manner, the first flap 50 and second flap 52 maybe zipped together, such as by a first closure mechanism 54 comprising a zipper. In further embodiments, the first closure mechanism 54 comprises snaps, buttons, and/or any other closure mechanism as desired.

With attention to FIG. 10 in addition to FIG. 1A, the top portion 10 also comprises a second closure mechanism 60. When the top portion 10 is flipped downward so that the first flap 50 and the second flap 52 are inside the main body 8, it may be possible but not desired to use the first closure mechanism 54 (such as a zipper) to close the main bag 4. The second closure mechanism 60 may be a magnetic closure and may be used in lieu of, or in addition to the first closure mechanism 54. For instance, the overlay closure flap 14 may include a magnet and/or ferromagnetic material which is connectable to a corresponding magnet and/or ferromagnetic material of the second closure mechanism 60. Thus, in various embodiments, the second closure mechanism 60 comprises at least one magnet disposed in the top portion 10. For instance, at least one magnet may be disposed in the first flap 50 and/or the second flap 52. In various embodiments, the second closure mechanism 60 comprises two magnets disposed in the top portion 10. For example a first magnet 128 and a second magnet 130 may both be positioned to align with the overlay closure flap 14, and specifically a selectable affixment member 66 of the overlay closure flap 14, such as a magnet or ferromagnetic material. In various embodiments the first magnet 128 and second magnet 130 facilitate closure of the overlay closure flap 14 when the top portion 10 is flipped up (selectably extended) and also when the top portion 10 is flipped down.

Turning now to FIGS. 3-6, and 10, specific features of the overlay closure flap 14 are now discussed. The overlay closure flap 14 may comprise a selectable affixment member 66. The selectable affixment member 66 may comprise a feature configured to selectably attach a portion of the overlay closure flap 14 to one of the first flap 50 and/or second flap 52. For example, the first flap 50 (or the second flap 52) may include a first magnet 128 and a second magnet 130. The selectable affixment member 66 may comprise a magnet oriented to align with the first magnet 128 and/or the second magnet 130 to facilitate closure of the overlay closure flap 14. The selectable affixment member 66 may thus comprise a magnet in the overlay closure flap 14. In further instances, the selectable affixment member 66 may comprise a ferromagnetic material inserted in the overlay closure flap 14.

Referring to FIGS. 3-6, and 10, the overlay closure flap 14 may comprise a main flap body 68. The main flap body 68 may comprise a flexible material configured to flap over the top of the top portion 10 and selectably engage with one of the first flap 50 and/or second flap 52 via the interaction of the selectable affixment member 66 with the second closure mechanism 60. In various embodiments, the main flap body 68 comprises a leather flap. In further embodiments, any material may be provided, as desired. The main flap body 68 may include embedded therein, the selectable affixment member 66 discussed above.

Figure 4:
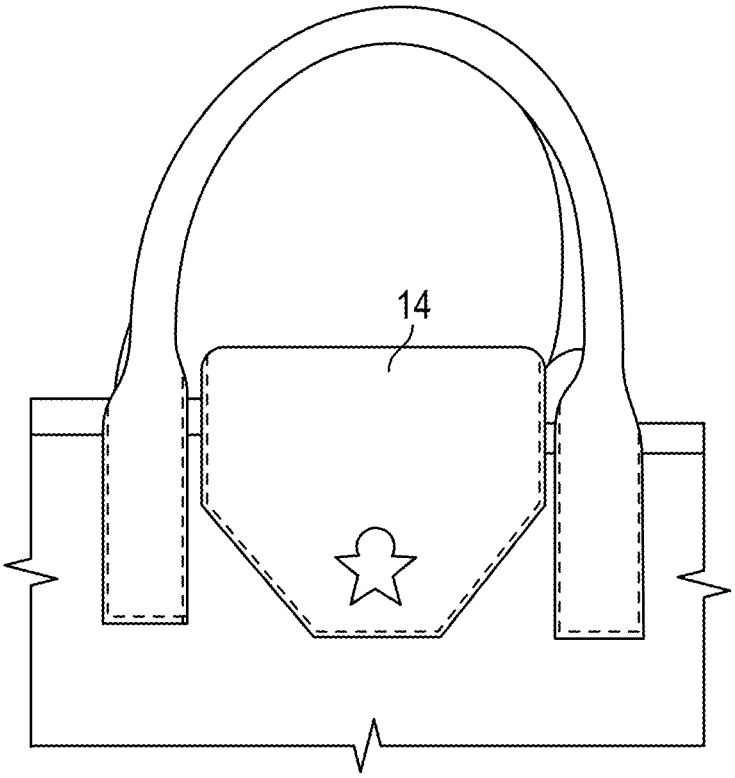
FIGS. 4-5 provide views of an overlay closure flap 14 of an example main bag of a reconfigurable purse assembly, in accordance with various embodiments.
Figure 5:
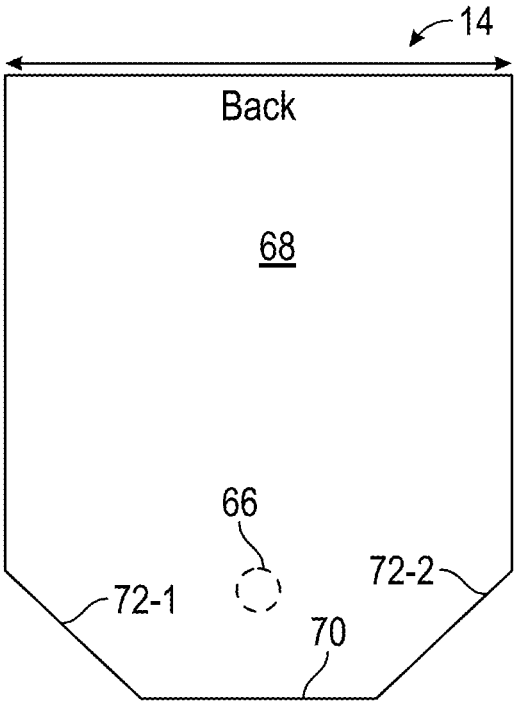

With reference to FIG. 4-6, the main flap body 68 may include a closure flap attachment mechanism 74. The closure flap attachment mechanism 74 may affix one end of the overlay closure flap 14 to the main bag 4. For instance, a first rivet 132 and a second rivet 134 may attach a main flap body 68 to a main body 8 of the main bag 4 below the MBTP juncture 12 (FIGS. 1A, 3). As used in the preceding sentence, "below" means on the side of the MBTP juncture 12 corresponding to the main body 8, and not the side corresponding to the top portion 10. In further instances, the first rivet 132 and the second rivet 134 may attach the main flap body 68 to the main body 8 of the main bag 4 at the MBTP juncture 12. Moreover, the rivets may be replaced with stitching and/or gluing. The main flap body 68 may extend away from the closure flap attachment mechanism 74 terminating at a distal edge 70. In various embodiments, the distal edge 70 aligns with the MBTP juncture 12 on an opposite side of the main bag 4 from the rivets when the selectable affixment member 66 is joined to at least one magnet of the second closure mechanism 60.

The main flap body 68 may be tapered along at least a portion of its length. For instance, the spacing between the first rivet 132 and the second rivet 134 may be a greater distance than the length of the distal edge 70. Consequently, one or more angled relief side 72 may extend from the distal edge 70. For instance, the distal edge 70 may be bounded by a first angled relief side 72-1 and a second angled relief side 72-2. The angled relief sides 72-1, 72-2 may angle inwardly toward each other such that the distal edge 70 is shorter than the spacing between the first rivet 132 and the second rivet 134.

Specific aspects of the strap fixation system 22 of the main bag 4 mentioned with reference to FIGS. 1A-B, 3, 6, 8, and 12 are also provided. For example, the strap fixation system 22 includes a first tab 84 and a second tab 88. A first tab 84 and/or a second tab 88 may comprise a loop of material, for instance leather, that attaches a first ring 86 and/or a second ring 89 (respectively), such as a metal ring, to the main bag 4. In various embodiments, the first tab 84 extends from the main body 8 at a location between the first edge 116 of the first flap 50 (e.g., corresponding to the first strap passage aperture 56) and the second tab 88 extends from the main body 8 at a location between the second edge 118 of the first flap 50 and the second edge 124 of the second flap 52 (e.g., corresponding to the second strap passage aperture 58). In various embodiments, one or both of the first tab 84 and the second tab 88 is offset a tab offset distance 87 (FIG. 8) toward one of the first flap 50 or the second flap 52. In other words, the first tab 84 may be non-centered within the space between the first edge 116 of the first flap 50 (e.g., offset within the first strap passage aperture 56) and the second tab 88 may be non-centered within the space between the second edge 118 of the first flap 50 and the second edge 124 of the second flap 52 (e.g., offset within the second strap passage aperture 58). Such offset placement may facilitate the vertical orientation of the main bag 4 when held by a user using the cross-body strap 25 (FIGS. 1B, 2, 12, 13-16). Moreover, such offset placement may facilitate resiliency of the main bag 4, wherein the first tab 84 and the second tab 88 are offset from stitching, such as that which joins the first larger panel 34 and second larger panel 36.

Figure 1B:
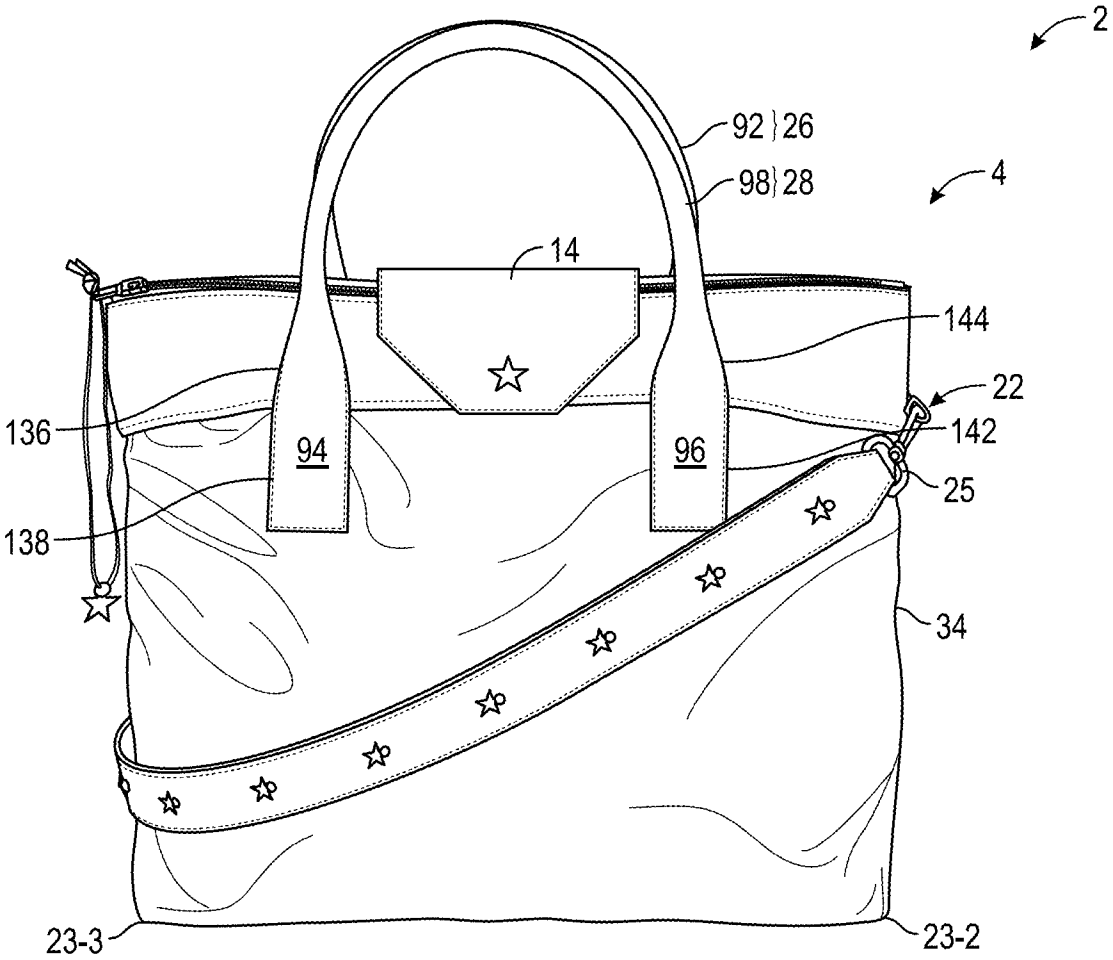
Figure 1C:
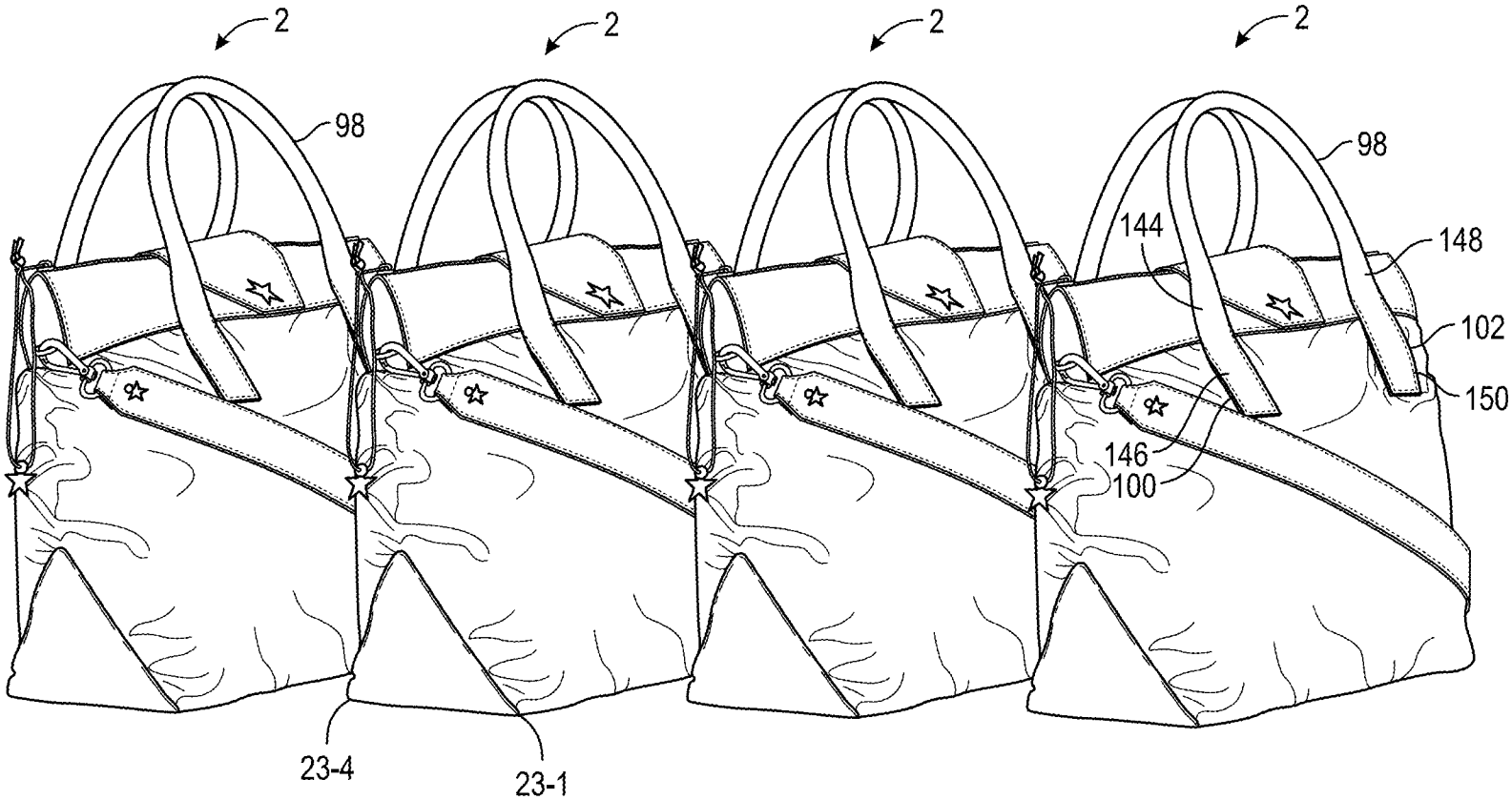
Figure 2:
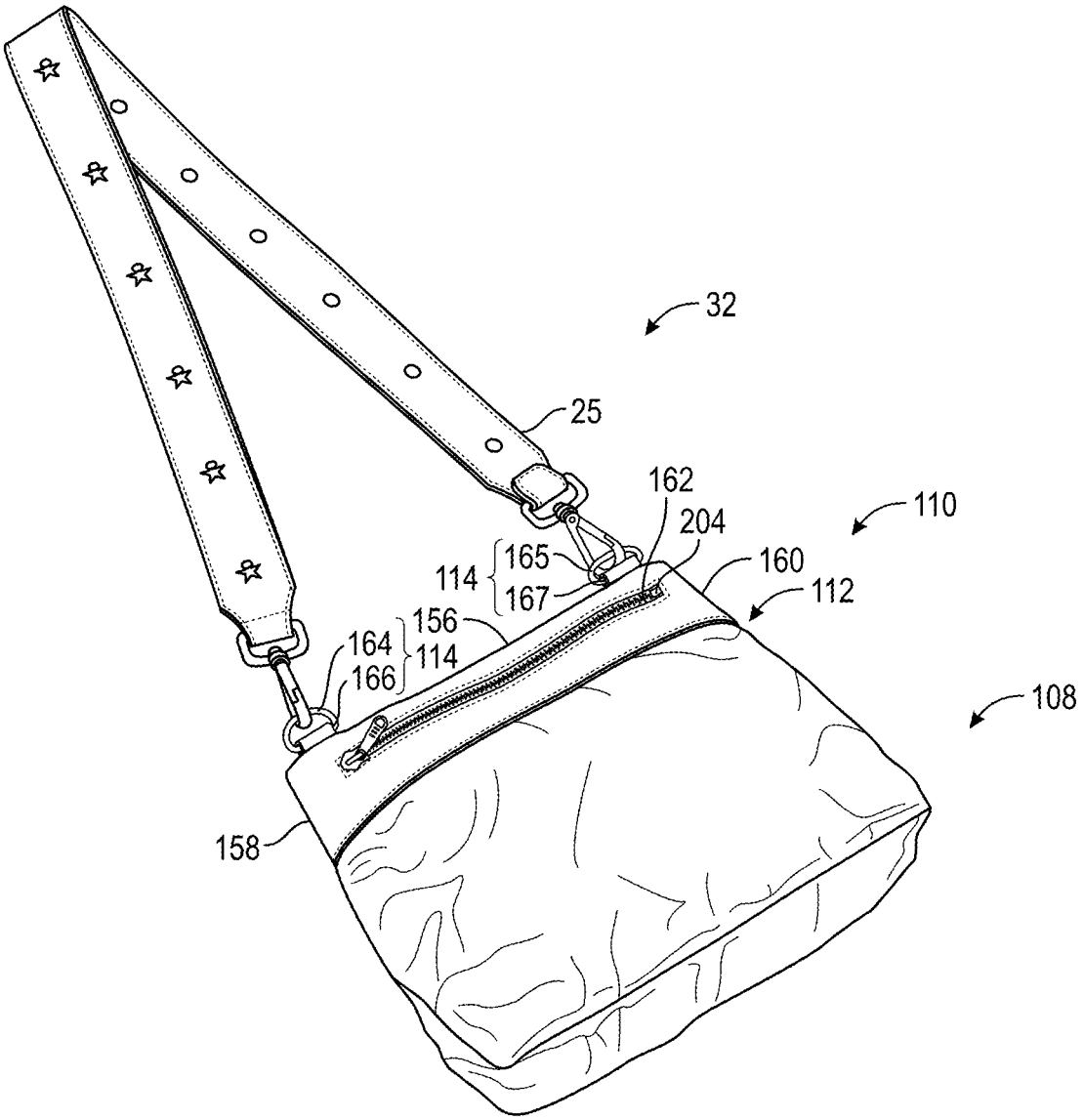
FIG. 2 depicts an example nesting bag of a reconfigurable purse assembly in connection with a cross-body strap, in accordance with various embodiments.

The first side handle 26 was introduced above. Attention is now directed to FIG. 1B for a detailed discussion of the first side handle 26. The first side handle 26 may comprise a handle attached to the first larger panel 34 of the main body 8. In various embodiments, the first side handle 26 comprises a first end tab 94 and a second end tab 96. A curved portion 92 may extend between the first end tab 94 and the second end tab 96. The curved portion 92 comprises a length of material configured for grasping by a person's hand to hold the main bag 4. The curved portion 92 may in various embodiments comprise a tubular member. In further instances, the curved portion 92 comprises a rounded member, a thickened member, or any readily grippable shape member as desired. The curved portion 92 may transition to flat tabs at each end—specifically, a first end tab 94 and a second end tab 96. The first end tab 94 and second end tab 96 connect to the first larger panel 34, such as by stitching.

The first end tab 94 may include several sections as well. For instance, the first end tab 94 may have a top portion transition section 136 that comprises a region of transition from tubular to flat. The top portion transition section 136 may be continuous with the curved portion 92 at one end and may be continuous with a main body attachment 138 at the other end. The first end tab 94 includes a main body attachment 138 as mentioned. The main body attachment 138 comprises a flat tab of material sewn to the main body 8 of the main bag 4, specifically, to the first larger panel 34.

The second end tab 96 may also include several sections. For instance, the second end tab 96 may have a top portion transition section 144 that comprises a region of transition from tubular to flat. The top portion transition section 144 may be continuous with the curved portion 92 at one end and may be continuous with a main body attachment 142 at the other end. The second end tab 96 includes a main body attachment 142 as mentioned. The main body attachment 142 comprises a flat tab of material sewn to the main body 8 of the main bag 4, specifically, to the first larger panel 34.

The second side handle 28 was introduced above. Attention is now directed to FIG. 6 for a detailed discussion of the second side handle 28 introduced above. The second side handle 28 may comprise a handle attached to the second larger panel 36 of the main body 8. In various embodiments, the second side handle 28 comprises a first end tab 100 and a second end tab 102. A curved portion 98 may extend between the first end tab 100 and the second end tab 102. The curved portion 98 comprises a length of material configured for grasping by a person's hand to hold the main bag 4. The curved portion 98 may in various embodiments comprise a tubular member. The curved portion 98 may transition to flat tabs at each end—specifically, a first end tab 100 and a second end tab 102. The first end tab 100 and second end tab 102 connect to the second larger panel 36, such as by stitching.

The first end tab 100 may include several sections as well. For instance, the first end tab 100 may have a top portion transition section 144 that comprises a region of transition from tubular to flat. The top portion transition section 144 may be continuous with the curved portion 92 at one end and may be continuous with a main body attachment 146 at the other end. The first end tab 100 includes a main body attachment 146 as mentioned. The main body attachment 146 comprises a flat tab of material sewn to the main body 8 of the main bag 4, specifically, to the second larger panel 36.

The second end tab 102 may also include several sections. For instance, the second end tab 102 may have a top portion transition section 148 that comprises a region of transition from tubular to flat. The top portion transition section 148 may be continuous with the curved portion 98 at one end and may be continuous with a main body attachment 150 at the other end. The second end tab 102 includes a main body attachment 150 as mentioned. The main body attachment 150 comprises a flat tab of material sewn to the main body 8 of the main bag 4, specifically, to the second larger panel 36.

Figure 17:
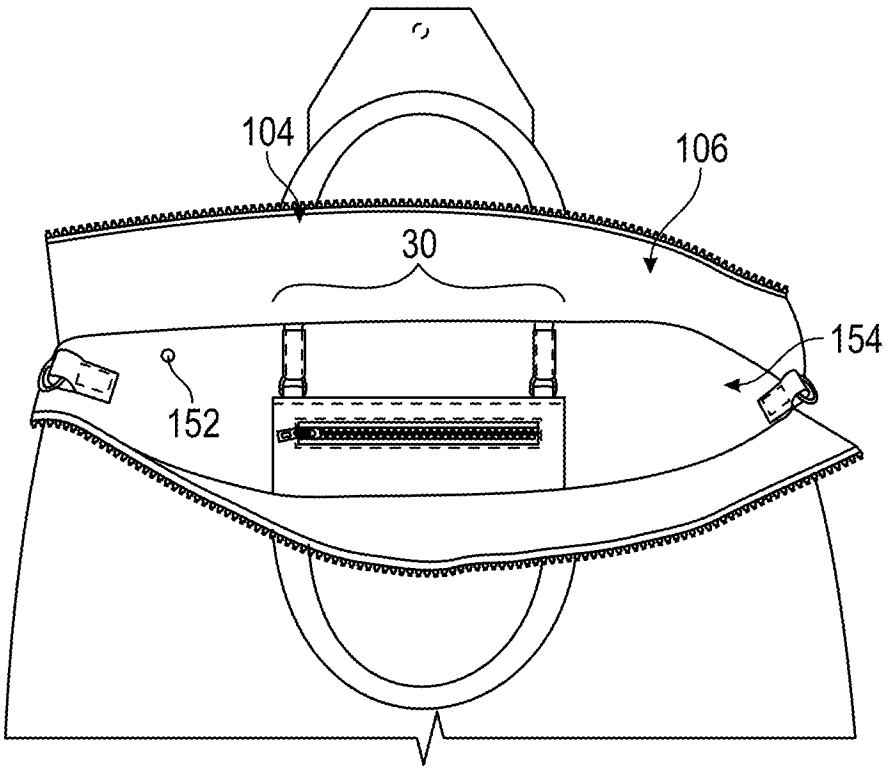
FIG. 17 depicts aspects of a nesting bag retention system of a reconfigurable purse assembly, in accordance with various embodiments.
Figure 18:
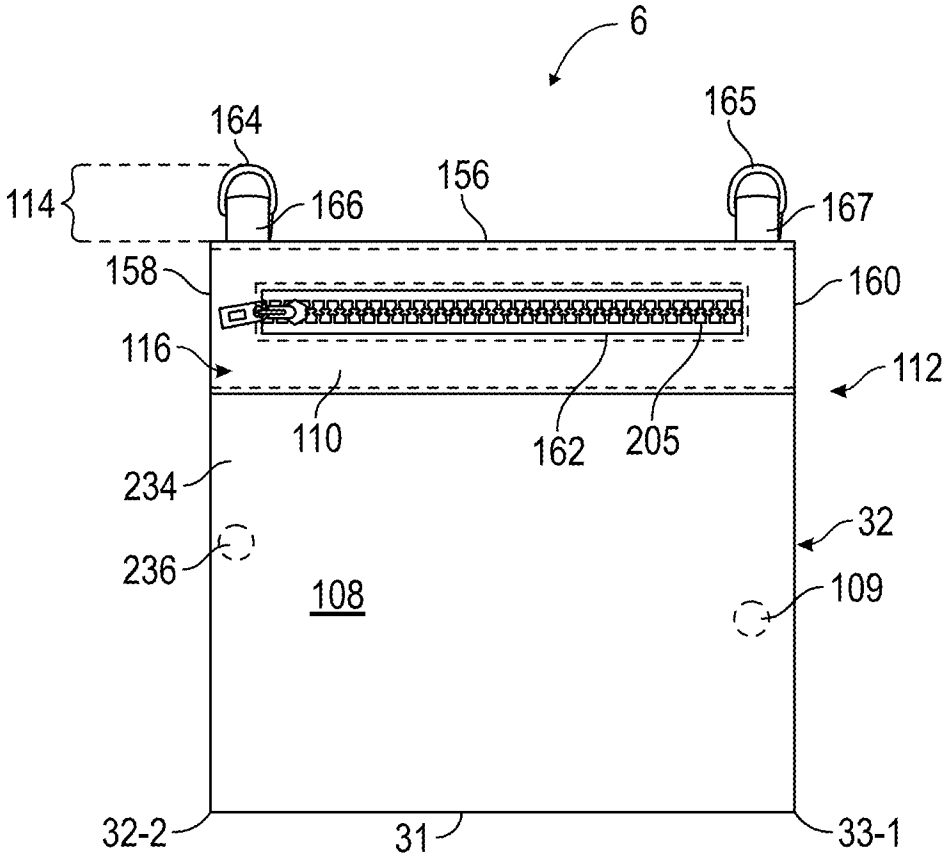
FIG. 18 provides a front view of an example nesting bag of a reconfigurable purse assembly, in accordance with various embodiments.
Figure 19:
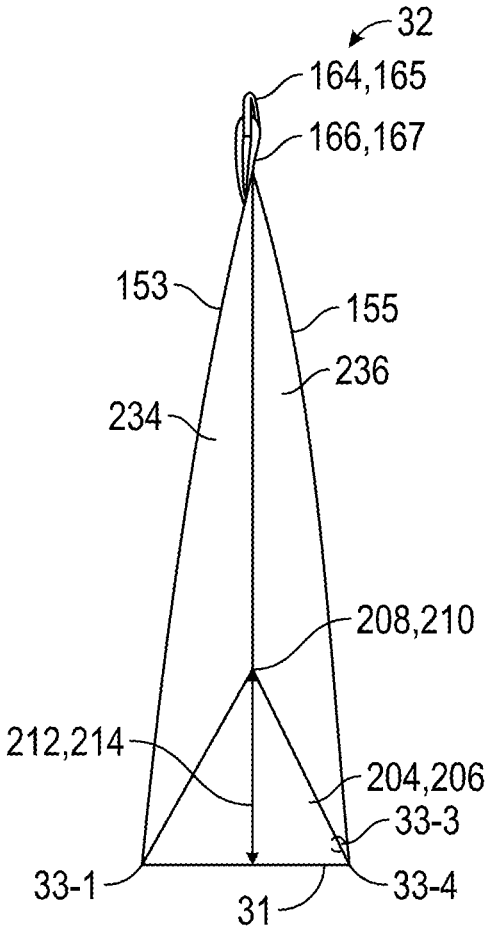
FIGS. 19 and 21 provide side views of an example nesting bag of a reconfigurable purse assembly, in accordance with various embodiments.
Figure 20:
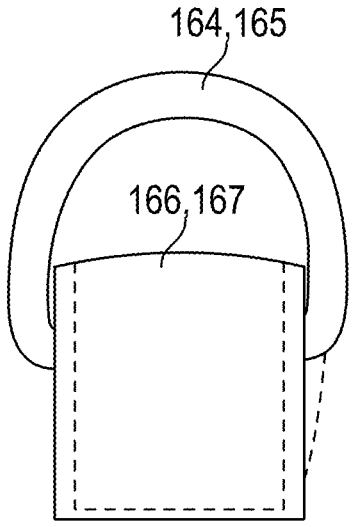
FIG. 20 provides a view of further aspects of a nesting bag retention system of a reconfigurable purse assembly, in accordance with various embodiments.
Figure 21:
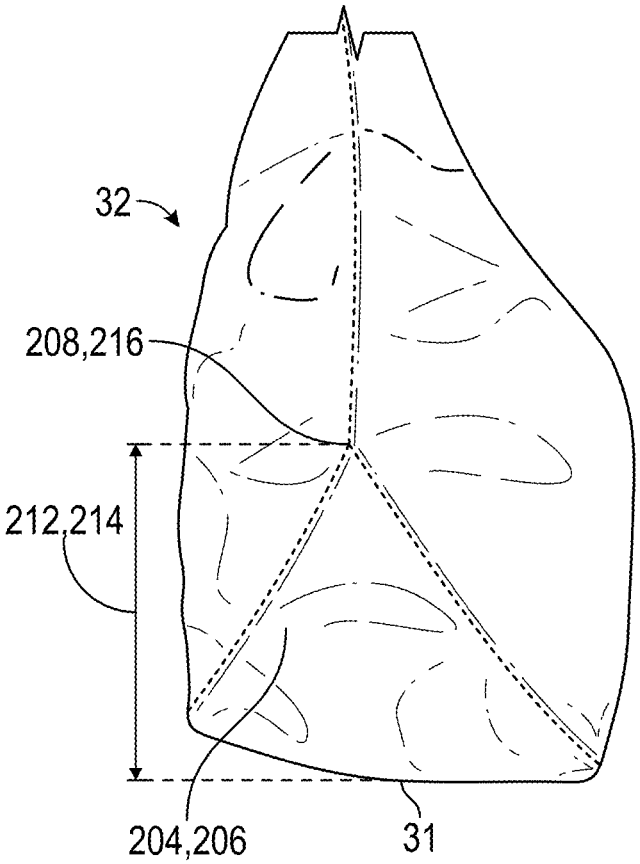

With focus now on FIGS. 1A and 17, the nesting bag retention system 30 is now detailed. For example, the nesting bag retention system 30 includes a first selectable attachment member 104. A first selectable attachment member 104 comprises a mechanism that can both attach to, and detach from, the nesting bag 6, under the control of a user. For example, the first selectable attachment member 104 may comprise a first strap 152. The first strap 152 may extend from the main bag 4, for instance, into the cavity defined by the main bag 4, and may connect to a nesting bag 6. The first strap 152 may connect to the nesting bag 6 by looping through a ring provided by the nesting bag and attaching to itself. In various instances the first strap 152 may be leather, though any material may be contemplated as desired.

The nesting bag retention system 30 may also include a second selectable attachment member 106. A second selectable attachment member 106 comprises a mechanism that can both attach to, and detach from, the nesting bag 6, under the control of a user. For example, the second selectable attachment member 106 may comprise a second strap 154. The second strap 154 may extend from the main bag 4, for instance, into the cavity defined by the main bag 4, and may connect to a nesting bag 6. The second strap 154 may connect to the nesting bag 6 by looping through a ring provided by the nesting bag and attaching to itself. In various instances the second strap 154 may be leather, though any material may be contemplated as desired.

Both or either of first strap 152 and second strap 154 may have features to facilitate the compact emplacement of the nesting bag 6 inside the main bag 4 while providing empty space inside the main bag 4 for the storage of other articles. For instance, first strap 152 may include a first curve portion 168 with a first curve portion length 184, a second curve portion 170 with a second curve portion length 186, a grasp tab 172 with a grasp tab length 188, and a connection member 174 with further features, such as a hole 190 and a pin 192.

The first curve portion 168 may comprise a length of the first strap 152 extending from the main body 8 of the main bag 4. In various embodiments, the first curve portion 168 extends from an intersection of the top portion 10 and the main body 8, for instance, the MBTP juncture 12. The first curve portion 168 may rest curvedly against the liner 20 of the main bag 4. The first curve portion 168 may thus dangle into the cavity of the main bag 4. The first curve portion 168 may transition, after a first curve portion length 184, to a second curve portion 170. The second curve portion 170 may be a section of the first strap 152 curved back in a generally opposite direction of the first curve portion 168. For instance, the first strap 152 may be curved back toward the intersection of the top portion 10 and the main body 8, for instance, toward the MBTP juncture 12. The second curve portion 170 may extend for a second curve portion length 186. At the end of the second curve portion length 186, a connection member 174 may connect the second curve portion 170 to the first curve portion 168. Thus, the combination of the first curve portion 168, the second curve portion 170, and the interconnection therebetween provided by the connection member 174, forms a closed loop. A portion of first strap 152 may extend past the connection member 174 to facilitate gripping by a user of the first strap 152. This portion may be termed a grasp tab 172 and has a grasp tab length 188. The nesting bag 6 may be attached to the closed loop whereby the nesting bag 6 is selectably connected to the main bag 4. The connection member 174 may be selectably connected. For instance, upon disconnecting of the connection member 174, the second curve portion 170 and the first curve portion 168 no longer provide a closed loop. Thus the nesting bag 6 may be removed from the main bag 4.

In various embodiments, the first curve portion length 184 is longer than the second curve portion length 186. Moreover, in further embodiments, the first curve portion length 184 is longer than the sum of the second curve portion length 186 and the grasp tab length 188. In this manner, the second curve portion 170 and the grasp tab 172 may both lay against the first curve portion 168, ameliorating catching of the second curve portion 170 and/or grasp tab 172 on articles in the main bag 4 and inadvertent separation of the connection member 174.

The connection member 174 may comprise a snap, magnetic closure, clip, safety pin, button, zipper and/or the like. However, as shown in FIG. 1A, the connection member 174 comprises a hole 190 and a pin 192. The pin 192 extends normal to a face of the first curve portion 168 and is received into a hole 190 defined through the second curve portion 170. The pin 192 frictionally engages with the hole 190.

Focusing now on the second selectable attachment member 106, one will recognize that similar features are provided as are provided for the first selectable attachment member 104. The first selectable attachment member 104 and second selectable attachment member 106 may be disposed proximate to opposite ends of a top edge of the nesting bag 6 so that the nesting bag 6 hangs stably inside the main bag 4. Specifically, the second selectable attachment member 106 includes a second strap 154. The second strap 154 may include a first curve portion 176 with a first curve portion length 194, a second curve portion 178 with a second curve portion length 196, a grasp tab 180 with a grasp tab length 198, and a connection member 182 with further features, such as a hole 200 and a pin 202.

The first curve portion 176 may comprise a length of the second strap 154 extending from the main body 8 of the main bag 4. In various embodiments, the first curve portion 176 extends from an intersection of the top portion 10 and the main body 8, for instance, the MBTP juncture 12. The first curve portion 176 may rest curvedly against the liner 20 of the main bag 4. The first curve portion 176 may thus dangle into the cavity of the main bag 4. The first curve portion 176 may transition, after a first curve portion length 194, to a second curve portion 178. The second curve portion 178 may be a section of the second strap 154 curved back in a generally opposite direction of the first curve portion 176. For instance, the second strap 154 may be curved back toward the intersection of the top portion 10 and the main body 8, for instance, toward the MBTP juncture 12. The second curve portion 178 may extend for a second curve portion length 196. At the end of the second curve portion length 196, a connection member 182 may connect the second curve portion 178 to the first curve portion 176. Thus, the combination of the first curve portion 176, the second curve portion 178, and the interconnection therebetween provided by the connection member 182, forms a closed loop. A portion of second strap 154 may extend past the connection member 182 to facilitate gripping by a user of the second strap 154. This portion may be termed a grasp tab 180 and has a grasp tab length 198. The nesting bag 6 may be attached to the closed loop whereby the nesting bag 6 is selectably connected to the main bag 4. The connection member 182 may be selectably connected. For instance, upon disconnecting of the connection member 182, the second curve portion 178 and the first curve portion 176 no longer provide a closed loop. Thus the nesting bag 6 may be removed from the main bag 4.

In various embodiments, the first curve portion length 194 is longer than the second curve portion length 196. Moreover, in further embodiments, the first curve portion length 194 is longer than the sum of the second curve portion length 196 and the grasp tab length 198. In this manner, the second curve portion 178 and the grasp tab 180 may both lay against the second curve portion 178, ameliorating catching of the second curve portion 178 and/or grasp tab 180 on articles in the main bag 4 and inadvertent separation of the connection member 182.

The connection member 182 may comprise a snap, magnetic closure, clip, safety pin, button, zipper and/or the like. However, as shown in FIG. 1A, the connection member 182 comprises a hole 200 and a pin 202. The pin 202 extends normal to a face of the second curve portion 178 and is received into a hole 200 defined through the second curve portion 178. The pin 202 frictionally engages with the hole 200.

Having concluded the discussion of the main bag 4, attention is now directed to the nesting bag 6. With reference to FIGS. 1A, 2, and 18-21, a nesting bag 6 may include a main nesting bag body 32. The main nesting bag body 32 may comprise an openable vessel configured to receive and retain personal items, etc. For example, a main nesting bag body 32 may comprise a nylon bag having an opening for the insertion of personal items. The main nesting bag body 32 may have different portions. For instance, a lower pouch 108 may comprise the nylon bag aspect of the main nesting bag body 32 and an upper portion 110 may comprise an aspect of the main nesting bag body 32 with an opening.

The upper portion 110 and the lower pouch 108 may be joined together by a main body to upper portion seam 112. For example, a main body to upper portion seam 112 may comprise one of stitching, gluing, and/or the like.

A main bag/strap attachment system 114 may extend from the upper portion 110. The main bag/strap attachment system 114 may provide a connection that is selectably connectable by the nesting bag retention system 30 (FIGS. 1A, 17) to the main bag 4. The main bag/strap attachment system 114 may also provide a connection that is selectably connectable to a cross-body strap 25 (FIGS. 1B, 2, 3, 6, 12, and 13-16).

The lower pouch 108 may have additional specific and unique features. For instance, with reference to FIGS. 1A, 2, and 18-21, the lower pouch 108 may include a first lower pouch larger panel 234 and a second lower pouch larger panel 236. The first lower pouch larger panel 234 comprises a larger side of the lower pouch 108. Similarly, the second lower pouch larger panel 236 comprises a larger side of the lower pouch 108. The first lower pouch larger panel 234 and the second lower pouch larger panel 236 may be a same size, or may be different sizes.

The first lower pouch larger panel 234 and the second lower pouch larger panel 236 are sewn together at corresponding edges along at least a portion of the length of the relevant edges. For example, a first lower pouch larger panel 234 and a second lower pouch larger panel 236 are sewn together from the main body to upper portion seam 112 and/or the upper most edge of the upper portion 110 (depending on the embodiment) downwardly along the lower pouch 108 (and in various embodiments, the upper portion 110).

The lower pouch 108 may have a lower pouch first side insert 204 and a lower pouch second side insert 206. The lower pouch first side insert 204 may comprise a triangular panel. For instance, the first lower pouch larger panel 234 and the second lower pouch larger panel 236 may be sewn together downwardly along the lower pouch 108 to a vertex of the lower pouch first side insert 204, the vertex comprising a lower pouch first seam intersection point 208. The first lower pouch larger panel 234 may be sewn to one side of lower pouch first side insert 204 extending from the vertex comprising the lower pouch first seam intersection point 208. The second lower pouch larger panel 236 may be sewn to another side of the lower pouch first side insert 204 extending from the vertex comprising the lower pouch first seam intersection point 208. The lower pouch first side insert 204 may facilitate a widening of the lower pouch 108 at distances farther away from the main body to upper portion seam 112. In various embodiments, the lower pouch first seam intersection point 208 is spaced a lower pouch first side insert seam offset distance 212 from the floor 31 of the main nesting bag body 32. In various instances, the lower pouch first side insert seam offset distance 212 is less than one half the height of the lower pouch 108.

The lower pouch 108 may also include a lower pouch second side insert 206. A lower pouch second side insert 206 may comprise a triangular panel. For instance, the first lower pouch larger panel 234 and the second lower pouch larger panel 236 may be sewn together downwardly along the lower pouch 108 to a vertex of the lower pouch second side insert 206, the vertex comprising a lower pouch second seam intersection point 210. The first lower pouch larger panel 234 may be sewn to one side of the lower pouch second side insert 206 extending from the vertex comprising the lower pouch second seam intersection point 210. The second lower pouch larger panel 236 may be sewn to another side of the lower pouch second side insert 206 extending from the vertex comprising the lower pouch second seam intersection point 210. The lower pouch second side insert 206 may facilitate a widening of the main nesting bag body 32 at distances farther away from the main body to upper portion seam 112. In various embodiments, the lower pouch second seam intersection point 210 is spaced a lower pouch second side insert seam offset distance 214 from the floor 31 of the main nesting bag body 32. In various instances, the lower pouch second side insert seam offset distance 214 is less than one half the height of the lower pouch 108.

The lower pouch second side insert 206 and the lower pouch first side insert 204 maybe disposed on opposite sides of the lower pouch 108. Thus the first lower pouch larger panel 234, the lower pouch first side insert 204, the second lower pouch larger panel 236, and the lower pouch second side insert 206 may be joined edge to edge to form the main body 8.

Moreover, the lower pouch first side insert 204 and the lower pouch second side insert 206 may comprise triangular end portions of a same piece of material with an interstitial rectangular portion therebetween providing the floor 31. Thus, one may appreciate that since the lower pouch first side insert 204 and the lower pouch second side insert 206 form portions of sides of the lower pouch 108, the interstitial rectangular portion extending between the lower pouch first side insert 204 and the lower pouch second side insert 206 may form a floor 31 of the lower pouch 108 (and the main nesting bag body 32). Thus, the union of the lower pouch first side insert 204 and the lower pouch second side insert 206, which may be of a same piece of material, to the first lower pouch larger panel 234 and the second lower pouch larger panel 236, may form a cavity with an opening proximate to the upper portion 110 and configured to receive articles for carrying. In various embodiments, the corners 33-1, 33-2, 33-3, 33-4 of the floor 31 of the main nesting bag body 32 are tucked inward, so that each corner 33-1, 33-2, 33-3, 33-4 comprises a local concave dimple of the main nesting bag body 32. In this manner, wear of the corners may be ameliorated as compared to traditional constructions which have pointed corners that tend to wear and/or fray.

The main nesting bag body 32 may include a liner 109. A liner 109 may comprise an inner surface of the main nesting bag body 32 defining the cavity of the bag. Although the bag may be made of a lower pouch 108 and a upper portion 110, in various embodiments, a liner 109 is shared by both the lower pouch 108 and a upper portion 110 and lines an inner surface of the main nesting bag body 32 provided by both the lower pouch 108 aspect and the upper portion 110 aspect. The liner 109 may be suede. The liner 109 may be any material as desired. The liner 109 may be affixed to the lower pouch 108 and/or upper portion 110 by at least one of stitching, gluing, and/or the like.

The upper portion 110 may be made of several aspects as well. For example an upper portion 110 may comprise one or more panel of material. In various embodiments, the upper portion 110 comprises a material more rigid than the lower pouch 108. For example, the lower pouch 108 may comprise nylon. The upper portion 110 may comprise leather. The upper portion 110 may comprise a first upper portion panel 153. The first upper portion panel 153 may be attached to a first lower pouch larger panel 234. The second lower pouch larger panel 236 may a reverse side of the main nesting bag body 32 opposite the first lower pouch larger panel 234. Thus, the second lower pouch larger panel 236 may actually also be a panel of the upper portion 110. In further instances, a second upper portion panel 155 is provided to form a reverse side of the upper portion 110. The first upper portion panel 153 may be attached to the first lower pouch larger panel 234. The second upper portion panel 155 may be attached to the second lower pouch larger panel 236. Thus, the combination of the first upper portion panel 153 and the second upper portion panel 155 (if provided), or the combination of the first upper portion panel 153 and a part of the second lower pouch larger panel 236 the upper portion 110 of the main nesting bag body 32.

The upper portion 110 may include sewn edges. For instance, the first upper portion panel 153 and the second upper portion panel 155 or the second lower pouch larger panel 236 may be sewn together along three edges. A closed upper edge 156 may be sewn, a first closed side edge 158 may be sewn, and a second closed side edge 160 may be sewn. A fourth edge may be attached to the lower pouch 108. Thus, the upper portion 110 and lower pouch 108 may form a closed container.

A closable aperture 162 may be define through the first upper portion panel 153 of the upper portion 110. The closable aperture 162 provides a passage into an interior space of the main nesting bag body 32 for insertion of articles to be carried. The upper portion 110 may also include a zipper 205 configured to selectably close the closable aperture 162.

Specific aspects of the main bag/strap attachment system 114 of the main nesting bag body 32 are now detailed. For example, the main bag/strap attachment system 114 includes a first tab 166. A first tab 166 comprises a loop of material, for instance leather, that attaches a first ring 164, such as a metal ring, to the nesting bag 6. In various embodiments, the first tab 166 extends from the main nesting bag body 32 at a location along the closed upper edge 156 nearer to the first closed side edge 158 than to the second closed side edge 160. Similarly, the second tab 167 extends from the main nesting bag body 32 at a location along the closed upper edge 156 nearer to the second closed side edge 160.

Various benefits and advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, and any elements that may cause any benefit or advantage to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A reconfigurable purse assembly comprises:

a main bag comprising a main body portion and a top portion attached to the main body portion, wherein the top portion includes a first flap and a second flap proximate to an opening of the main body portion and that are selectably extendable;

an overlay closure flap comprising a main flap body attached to a first side of the main bag by a closure flap attachment mechanism and selectably magnetically attachable to a second side of the main bag at at least one of a plurality of magnetic closures, a first closure mechanism comprising a zipper to connect the first flap and the second flap, a liner having an inner surface of the main bag defining a cavity of the bag, wherein the liner is shared by both the main body and the top portion, wherein the first flap extends along a portion of a top edge of the main bag, the first flap is selectably extendable by hingeably extending the first flap from the main body away from the opening of the main body, and the first flap is selectably retractable by hingeably extending the first flap from the main body into the opening of the main body, wherein a hinge of the first flap is provided by a seam joining the main body of the main bag to the top portion of the main bag, wherein the second flap extends along another portion of the top edge of the main bag, the second flap is selectably extendable by hingeably extending the second flap from the main body away from the opening of the main body, and the second flap is selectably retractable by hingeably extending the second flap from the main body into the opening of the main body, wherein a hinge of the second flap is provided by the seam joining the main body of the main bag to the top portion of the main bag, wherein a first magnetic closure of the plurality of magnetic closures accommodates the overlay closure flap crossing over the top portion in a selectably retracted configuration, and wherein a second magnetic closure of the plurality of magnetic closures accommodates the overlay closure flap crossing over the top portion in the selectably extended configuration.

2. The reconfigurable purse assembly according to claim 1, wherein the closure flap attachment mechanism comprises a first rivet and a second rivet connecting the main flap body of the overlay closure flap to the main body portion of the main bag.

3. The reconfigurable purse assembly according to claim 1, wherein the overlay closure flap comprises a magnet inside the main flap body and attachable to the at least one of the plurality of magnetic closures.

4. The reconfigurable purse assembly according to claim 1, wherein the first flap of the top portion further comprises a first edge and a second edge, wherein the second flap of the top portion comprises a first edge and a second edge, wherein the first edge of the first flap and the first edge of the second flap are facing edges and spaced apart defining a first strap passage aperture therebetween, and wherein the second edge of the first flap and the second edge of the second flap are facing edges and spaced apart defining a second strap passage aperture therebetween.

5. The reconfigurable purse assembly according to claim 4, further comprising a cross-body strap passing through the first strap passage aperture and passing through the second strap passage aperture and connected to the main body inside the cavity of the bag.

6. The reconfigurable purse assembly according to claim 1, the main bag further comprising a nesting bag retention system configured to selectably connect to a nesting bag in the main bag.

7. The reconfigurable purse assembly according to claim 6, the nesting bag retention system comprising a first strap extending from the main bag into the cavity defined by the main bag and looping through a ring provided by the nesting bag, wherein the first strap selectably connects to itself to retain the nesting bag.

8. The reconfigurable purse assembly according to claim 1, the main body portion of the main bag comprising:

a first larger panel comprising a larger side of the main body;

a second larger panel comprising a larger side of the main body opposite the first larger panel, the first larger panel and the second larger panel sewn together at corresponding edges from a main-body-to-top-portion-juncture downwardly along the main body to a vertex of the first side insert comprising a first seam intersection point;

a first side insert comprising a triangular panel sewn on one side to the first larger panel from the vertex comprising the first seam intersection point to a floor of the main body and sewn on another side to the second larger panel from the vertex comprising the first seam intersection point to the floor of the main body, the first larger panel and the second larger panel also sewn together at further corresponding edges from the main-body-to-top-portion-juncture downwardly along the main body to a vertex of the second side insert comprising a second seam intersection point;

a second side insert comprising a triangular panel sewn on one side to the first larger panel from the vertex comprising the second seam intersection point to the floor of the main body and sewn on another side to the second larger panel from the vertex comprising the second seam intersection point to the floor of the main body;

wherein the floor, the second side insert, and the first side insert are a single piece of material.

9. The reconfigurable purse assembly according to claim 8, wherein the vertex of the first side insert is spaced first side insert seam offset distance from the floor, wherein the vertex of the second side insert is spaced a second side insert seam offset distance from the floor, wherein the first side insert seam offset distance is less than one half a height of the main body measured from the floor of the main body, and wherein the second side insert seam offset distance is less than one half the height of the main body measured from the floor of the main body.

10. The reconfigurable purse assembly, according to claim 1, wherein the main body portion comprises a floor having corners, and wherein the corners are tucked inward comprising a local concave dimple of the main body.

11. The reconfigurable purse assembly according to claim 1, wherein the liner is comprises two or more portions.

* * * * *